United States Patent [19]

Hepperle et al.

[11] Patent Number: 4,912,291

[45] Date of Patent: Mar. 27, 1990

[54] COMPACT PROXIMITY SWITCH ARRANGEMENT

[75] Inventors: Ralf Hepperle, Schwaikheim; Kurt Stoll, Esslingen, both of Fed. Rep. of Germany

[73] Assignee: Festo KG, Esslingen, Fed. Rep. of Germany

[21] Appl. No.: 257,389

[22] Filed: Oct. 13, 1988

[30] Foreign Application Priority Data

Oct. 13, 1987 [DE] Fed. Rep. of Germany ..... 3734525

[51] Int. Cl.[4] ..... H01H 35/38

[52] U.S. Cl. ..... 200/82 E; 73/745; 340/626

[58] Field of Search ..... 307/118; 335/205; 91/1; 92/5 R; 73/744, 745; 340/626; 361/178–180; 200/61.41, 293, 294, 82 E, 81.9 M, 81 R

[56] References Cited

U.S. PATENT DOCUMENTS

| | | | |
|---|---|---|---|
| 4,071,725 | 1/1978 | Smith | 200/82 E |
| 4,600,436 | 7/1987 | Brausfeld | 73/745 |
| 4,752,657 | 6/1988 | Kane | 200/82 E |
| 4,755,636 | 7/1988 | Akio | 200/82 E |
| 4,793,188 | 12/1988 | Strasser . | |
| 4,800,241 | 1/1989 | McNamara | 200/82 E |

*Primary Examiner*—Gerald P. Tolin

*Attorney, Agent, or Firm*—McGlew & Tuttle

[57] ABSTRACT

The invention is concerned with switch devices and more particularly with devices to be fitted to piston and cylinder actuators to monitor the position of the piston therein. The device comprises a switch which has two connection or terminal contacts arranged at its axially opposite ends. These terminal contacts are respectively connected with signal conductors which may for instance be in the form of flexible cable wire. The switch is accommodated in a sleeve surrounding it. The two signal conductors are extended as far as a common axial terminal or connection end of the switch. For producing an electrical connection of the one signal conductor with the second terminal contact the current is caused to flow through the sleeve.

24 Claims, 1 Drawing Sheet

Fig. 1
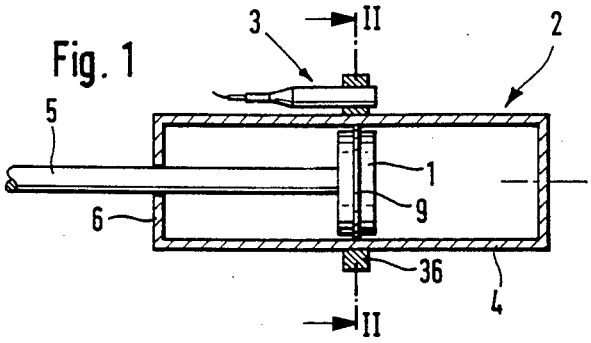
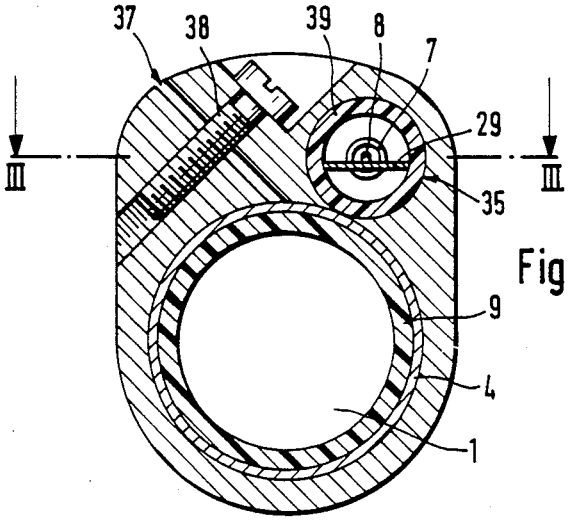
Fig. 2
Fig. 3
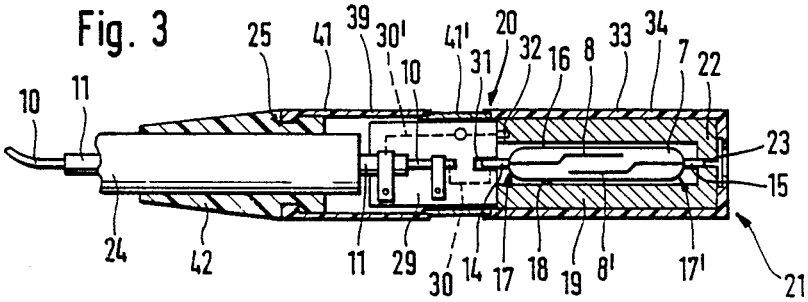

COMPACT PROXIMITY SWITCH ARRANGEMENT

BACKGROUND OF THE INVENTION

The invention relates to a switch device and more particularly to a switch device to be responsive to given positions of a piston and cylinder unit, comprising a switch which is to be mounted externally on the barrel of the cylinder and piston unit and which has two terminals adapted to be connected with signal conductors, for example conductors in the form of flexible wires.

Such switch devices are employed to indicate certain positions of moving components or in order to cause certain switching operations to take place in response to given settings of such components. Most frequently such switch devices are used in conjunction with piston and cylinder units in order to respond to certain positions of the piston in such a unit. For instance, they may be used to indicate when the piston of the unit is in its end positions, so as to cause a reversal in the direction of motion of the piston when its reaches certain positions or to cause one of a variety of other possible functions. The switch used is preferably in the form of a reed contact switch which has two spaced switching contacts and is arranged externally on the outer peripheral surface of the cylinder barrel. The actuation of the switch is caused in a contactless manner by the piston itself, which for this purpose carries a permanent magnet which operates the two switching contacts as the piston moves by owing to the action of the magnetic field.

Since such switches are relatively sensitive to external effects it is recommended to accommodate them in a housing. However this means that the switch unit then has relatively large dimensions so that a piston and cylinder unit fitted with such a switch device has a large radial dimension for part of its length; this means that the switch device is only rarely suitable when there is a shortage of space. However it is in such applications, as for instance in industrial robots; that the use of such switches is required. A further point is that the arrangement may often not be designed to have a small enough distance between the switch and the cylinder with the result that the magnetic field does not reliably operate the switch.

SHORT SUMMARY OF THE INVENTION

Accordingly one object of the present invention is to provide a switching device of the initially described type in which the switch is accorded a high degree of protection.

A further object is to ensure that the switching action is sufficiently reliable.

A still further aim of the invention is to provide a compact and space saving design.

In order to achieve these or other objects of the invention appearing from the specification and claims, the switch is mounted in a surrounding guard sleeve so that its terminal contacts are provided at the opposite axial ends of the device and the two signal conductors extend as towards the common axial terminal end of the switch, the guard sleeve serving to electrically connect the one signal conductor with the second terminal contact of the switch opposite to the terminal end.

The result of this design is a compact arrangement, since the two signal conductors only have to extend to one of the axial ends of the switch. It is not necessary to provide any wiring beyond this which would take up much space. For while the one signal conductor is able to be connected with the terminal contact located on the terminal end, the electrical connection of the other signal conductor is connected with the opposite terminal contact via the guard housing. It thus performs two functions, that is to say on the one hand it has the aim of conducting the current and on the other hand a protective function in order to preclude damage to the switch housed in it. The structure of the switch device makes it possible for it to be so mounted on the exterior periphery of a cylinder that its axial direction extends in parallelism to the longitudinal direction of the piston. The radial dimensions of the piston and cylinder unit may in this manner be reduced to a minimum so that even its application in devices where space is at premium is readily possible. In this respect the guard sleeve may also serve as an attachment member by way of which the switch device is secured to the cylinder. All in all, the switch device in accordance with the invention will be seen to have a small number of components so that manufacture is possible at a low cost.

Advantageous further developments of the invention are defined in the claims.

It is convenient if the guard sleeve at least in part consists of material with electrically conducting properties, the one signal conductor being connected with the electrically conducting part of the guard sleeve, which for its part is electrically connected with a second terminal contact opposite to the terminal side. Preferably the guard sleeve is however made entirely of electrically conducting material, and more especially it may be made of brass, this simplifying the production and assembly of the protective sleeve to a substantial extent. There is additionally the possibility of not making the guard sleeve of electrically conducting material initially but rather of a material which is subsequently provided with electrical wiring defining a current path.

It is an advantage if the switch is replaceably inserted in the protective sleeve, its second terminal contact being electrically connected with the protective sleeve so that if a defect should occur, rapid renewal is ensured. For this purpose the guard sleeve may have a terminating wall at the axial side opposite to the terminal side or end, such wall having a female opening for receiving the second connected contact in the form of a male or plug-in contact element.

In order not to have any interfering effect on the operation of the switch it is expedient if the guard sleeve be made of nonmagnetic material.

If the guard sleeve and preferably the switch as well, are made cylindrical and more especially circularly cylindrical, the switch device will have compact dimensions.

As an axial extension of the guard sleeve and at the terminal side thereof there is preferably a printed circuit board placed in the signal path between the signal conductors and the terminal contacts, such circuit board preferably having indicating elements as for instance LEDs so that the respective condition of switch may be seen by eye. The printed circuit board is preferably connected with the terminal contact of the switch arranged on the terminal side by way of a releasable plug-in connector.

In order to preclude short circuits and to prevent damage to the guard sleeve when same is attached to the cylinder or the like, the sleeve is preferably arranged in an insulating housing, which consists of a material with electrically insulating properties. It is preferably in the form of circular a tube casing of plastic material shut off at one end and able to be inserted into the guard sleeve. Furthermore the circuit board and at least the terminal or connection part of the signal conductors are preferably arranged in a cylindrical casing, which adjoins the insulating housing. In order to ensure that the indicating elements may be seen, the casing may be made of transparent material where it is adjacent to them. This casing may also be made in two parts, with one of them made of a transparent material.

The attachment of the switch device to a cylinder or the like is preferably by means of a holder which on the one hand engages the guard sleeve and on the other hand is secured to the cylinder. This makes sure that the device is kept securely in place without damage of the switch or its signal conductors having to be feared.

The invention will now be described in more detail with reference to the accompanying drawing.

LIST OF THE SEVERAL VIEWS OF THE DRAWINGS

FIG. 1 is a longitudinal section taken through a piston and cylinder unit which is fitted with the switch device in accordance with the invention, shown as simplified representation.

FIG. 2 is a cross section taken through the arrangement of FIG. 1 on the section line II—II.

FIG. 3 is a section taken on the line III—III of FIG. 2, which shows an advantageous embodiment of the switch device, the holder and the cylinder being omitted to make the drawing more straightforward.

DETAILED ACCOUNT OF WORKING EXAMPLE OF THE INVENTION

The drawings show a particularly preferred field of application of the switch device in accordance with the invention, in the case of which it serves to generate and supply a switching or control signal in a manner responsive to the position of the piston 1 of a piston and cylinder unit 2. However it will be seen that there is a wide range of other applications in which the switch device 3 may be utilized in order to be operated in a contactless manner by a moving component. As an example of this it is possible to consider the operation of the switch by a traveling machine slide or by materials transporting equipment.

The piston and cylinder unit 2 comprises a cylinder 4 which is shut off at both ends and which contains an axially moving piston 1, which for its part is coaxially connected with a piston rod 6, which extends outwards through one cylinder end cover 5 with a seal therebetween. The switch device 3 comprises a switch 7 mounted on the outside of the cylinder 4 on its periphery. The switch is preferably in the form of a reed contact switch and, as is shown in FIG. 3, has two switching contacts 8 and 8' arranged with a clearance between them which is radial in relation to the longitudinal axis of the cylinder. The one moving part giving rise to a switching signal, that is to say the piston, bears a permanent magnet 9, emitting a magnetic field which causes contact between the two switching contacts 8 and 8' when the piston 1 moves past the switch. As a result the connection is produced between the two signal conductors 10 and 11, shown in the example of the invention as flexible wires, such conductors being connected with the terminal contacts 14 and 15 of the two switching contacts 8 and 8'.

The switch 7 has a circularly cylindrical enclosure or housing 16, which is preferably in the form of a glass envelope and whose two axial ends are in the form of spherical caps so that in longitudinal section the enclosure hs an oval form. The two terminal contacts 14 and 15 are located at the axial ends 17 and 17' at which they project in the axial direction like pins out of the housing 16.

The switch is located in the interior cavity 18 of a guard sleeve 19 with a circular cross section, such sleeve completely surrounding the switch 7 along its full length and along its full circumference. The interior cavity 18 and thus also the guard sleeve 19 open at one axial side or end, hereinafter referred to as the terminal or connection end 20, and from this end the switch 7 may be inserted into the guard sleeve 19 and withdrawn therefrom when desired. At the opposite axial end 21 the guard sleeve 19 is shut off by a terminating wall 22 preferably arranged in a radial plane and which has a plug-in opening 23, into which the associated second terminal contact 15 may be removably inserted in the installed state of the switch 7. The terminal contact 15 is thus a plug-in or male contact, which is engaged by the peripheral edge of the female opening 23.

In order to favor a compact design the two signal conductors 10 and 11 extend in the axial direction towards the terminal end of the switch 7, such conductors preferably being comprised in a coaxial cable 24, whose connection part 25 is arranged as a coaxial extension to the switch conductor 10 and is electrically connected with the one terminal contact.

The one signal conductor 10 of the switch 7 is electrically connected with the terminal contact 14 of the switch 7 placed at the terminal end 20. This connection may be produced quickly and simply by soldering or plugging using a suitable plugging adapter fitting, but however, as indicated in the working example, such connection may be one using a printed circuit board 29. The latter is located between the connection part 25 and the connection side 20 of the guard sleeve 19, the signal conductor 10 being screwed onto the circuit board 29 and connected via printed wiring 30 with a plug-in contact 31 on the circuit board, such contact being detachably placed on the terminal contact 14.

The most significant advantage of the switch device in accordance with the invention is that the second signal conductor 11, which also extends to the terminal side 20, is electrically connected with the terminal contact 15, located on the terminating wall 22, by way of the guard sleeve 19. This means that no cable or the like has to be extended to the second terminal contact 15 so that simple assembly is made possible and there is a compact radial dimension. In the working example the guard sleeve 19 consists entirely of electrically conducting material, more especially brass and serves therefore for the direct transmission of the current between the terminal contact 15 and the respective signal conductor 11. The attachment of the signal conductor 11 to the guard sleeve 19 may for example be by screwing, in which case a tapped hole is provided in the end side of the terminal face 20 of the guard sleeve 19. It would also be possible to have a plug-in connection, that is to say both directly by plugging the signal conductor 11 into a suitable end hole in guard sleeve 19 and, as an alternative to this, as shown in the FIG. 3. In this case the signal conductor 11 is screwed to the above-mentioned printed circuit board 29 and by way of a piece 30' of printed wiring an electrical connection is produced with a pin 32 arranged on the side, remote from the guard sleeve 19, of the circuit board 29. This pin is then plugged into a suitable recess in the guard sleeve 19 so that the current path is then from the signal conductor 11 and via the printed wiring 30', the pin 32, the guard sleeve 19, the terminating wall 22 of the guard sleeve 19 to the terminal contact 15.

In lieu of the selected working example of the invention it is possible for the guard sleeve to consist only partially of material with electrically conducting properties, in which case the one signal conductor 11 will be connected with the electrically conducting part of the guard sleeve, such part then for its part being electrically connected with the second terminal contact 15 remote from the terminal side 20. The illustrated design is however simpler and cheaper to produce. The same also applies in connection with another possible form of the invention, in which the guard sleeve is additionally provided with an electrical conductor for producing an electrical connection between the one signal conductor 11 and the second terminal contact 15. Such an electrical conductor might for instance be produced by vapor phase metallization.

Preferably the guard sleeve 19 is however produced of nonmagnetic material in any case so that the operation of the switching contacts 8 and 8' by the magnetic field of the permanent magnet 9 is not interfered with.

As already mentioned, the illustrated example of the part of the switch device 3 arranged on the cylinder has an elongated, slim tubular form with a circular cross section so that it is natural for it to be arranged on the outer face of the cylinder in parallelism therewith, as is in fact shown in FIGS. 1 and 2. Since the terminal side 20 of the signal conductors 10 and 11 is concentrated on the one axial end of the switch, it is possible for the arrangement to have a very narrow overall size in the radial direction with the result that the radial size of the piston and cylinder unit is hardly increased by the switch device thereon. This makes it possible for the arrangement to be employed where space is at a premium.

It will however be clear that the invention is not limited to the illustrated external configuration of the guard sleeve and the switch, other forms thereof being feasible with matching forms of the switch. It is however important that the switch is surrounded by the guard sleeve so that there is no danger of damage thereto. Likewise it is possible to use the guard sleeve 19 so as provide for attachment to the external face of the cylinder 4 on some other component. In this case it is convenient to accommodate the guard sleeve in a thin-walled insulating housing 33 as indicated in the drawing. As indicated in FIG. 3 the insulating housing is a tubular casing 34 with a circular cross section and shut off at one end. The guard sleeve may be entirely received in this casing, the terminating wall 22 of the sleeve being at the end thereof which is to the front when the sleeve is being inserted into the casing. The guard sleeve 19 surrounded by this guard casing 34 may then be mounted in a suitable hole 35 in a clamp 36 which embraces the cylinder 4. In order to secure the sleeve at any desired point along the length of the cylinder the clap 36 is slotted and provided with a clamping screw 38 adjacent to the slot so as to close it somewhat and clamp onto the outer face of the cylinder.

The circuit board 29 and the terminal part 25 of the cable 24 or of the signal conductors 10 and 11 are also preferably accommodated in such a way as to protect them. For this purpose, as may be seen from FIG. 3 a further tubular casing 39 adjoins the insulating housing 33 as an axial extension so as to surround the said parts.

The casing 39 is preferably also made of plastic or resin material and adjacent to the circuit board 29 is made so as to be at least partly transparent. The reason for this is the presence of an indicating element 40 mounted on the circuit board and preferably in the form of an LED or the like which may show the condition of the switch 7 and is to be visible from the outside. In the working example the casing 39 consists of two length sections 41 and 14', which are fitted together, the one length section 41' being made transparent and being detachably connected with the insulating housing 33.

At the axial side or end opposite to the insulating housing 33 the casing 39 is connected with a terminating part 42 consisting of flexible material and which surrounds the cable 24 so that the circuit board 29 is ultimately completely encapsulated.

We claim:

1. A switch arrangement comprising:

a switch element;

first and second terminal contacts disposed on said switch element arranged at opposite axial terminal ends of said switch element;

signal conductors arranged at one common axial terminal end of said switch element; and a guard sleeve surrounding said switch element, a portion of said guard sleeve being formed of material with electrically conducting properties, said guard sleeve electrically connecting one of said signal conductors with the second terminal contact of the switch element, said second terminal contact being remote from said one common axial terminal end, said first terminal contact being connected to another of said signal conductors.

2. The switch device as claimed in claim 1 wherein said portion of said guard sleeve formed of material with electrically conducting properties is formed of brass.

3. The switch device as claimed in claim 1 wherein said guard sleeve is made of nonmagnetic material.

4. The switch device as claimed in claim 1 wherein said guard sleeve is cylindrical and surrounds the switch coaxially.

5. The switch device as claimed in claim 1 further comprising a circuit board arranged at said one common axial terminal end of the guard sleeve as an axial extension thereof in a current path between the signal conductors and the terminal contacts.

6. The switch device as claimed in claim 5 wherein the circuit board is pluggingly connected with the terminal contact of the switch arranged on the terminal end of the switch.

7. The switch device as claimed in claim 1 wherein the switch is a reed contact switch.

8. The switch device as claimed in claim 1 wherein the guard sleeve is provided with an insulating housing composed of a material with electrically nonconducting properties.

9. The switch device as claimed in claim 8 wherein the insulating housing is in the form of a tubular casing shut off at one end and has the guard sleeve plugged into it.

10. The switch device as claimed in claim 1 comprising a clamp attaching the guard sleeve of the device to a cylinder of a piston cylinder arrangement.

11. A switch arrangement, comprising:

a switch element;

first and second signal contacts disposed on said switch element arranged at opposite axial terminal ends of said switch element;

first and second terminal conductors arranged adjacent one of said axial terminal ends of said switch element;

a guard sleeve formed entirely of electrically conducting material, said guard sleeve surrounding said switch element and electrically connecting said second terminal contact and said second signal conductor, said second terminal contact being arranged at a side of said switch element opposite said second signal conductor, said first terminal contact being connected to said first terminal conductor.

12. A switch arrangement, comprising: a switch element;

first and second terminal contacts disposed on said switch element arranged at opposite axial terminal ends of said switch element;

first and second signal conductors arranged at one axial end of said switch element;

a guard sleeve surrounding said switch element, said guard sleeve including a conductor electrically connected to said second terminal contact and electrically connected to said second signal conductor, said first terminal contact being connected to said first signal conductor; a circuit board positioned between said signal conductors and said switching element in a current path between said signal conductors and said terminal contacts, said circuit board and a portion of said signal conductors being accommodated in a tubular casing, said tubular casing being connected to and an extension of an insulating housing surrounding the guard sleeve, said insulating housing being formed of a material with insulating properties, said tubular casing being formed of a transparent material allowing viewing of an indicating element attached to said circuit board.

13. A switch arrangement comprising:

a switch element;

first and second terminal contacts disposed on said switch element arranged at opposite axial ends of said switch element;

first and second signal conductors arranged at one axial end of said switch element;

a guard sleeve surrounding said switch element, said guard sleeve including a conductor connecting said second terminal contact arranged at one axial terminal end and said second signal conductor arranged adjacent an axial terminal end opposite said one axial terminal end, said first terminal contact connected to said first signal conductor, said guard sleeve conductor being deposited on said guard sleeve by vapor phase metallization, said switch being detachably plugged into said guard sleeve, said signal conductors being in the form of flexible wires, said switch element being in the form of a circularly cylindrical rod connected with a circuit board, said circuit board having an indicating element, said circuit board being pluggingly connected with said first terminal contact, said guard sleeve being mounted in a plastic casing, said circuit board being mounted in a tubular casing adjoining said plastic casing as an axial extension thereof.

14. A switch arrangement comprising:

a switch element;

first and second terminal contacts disposed on said switch element arranged at opposite axial terminal ends of said switch element;

signal conductors arranged at one axial terminal end of said switch element; and, a guard sleeve surrounding said switch element, said guard sleeve having an electrically conductive portion which is electrically connected to a receiving electrical plug-in connector, said second terminal contact including a plug-in connector plugged into said receiving electrical plug-in connector of said guard sleeve, said guard sleeve conductive portion being connected to one of said signal conductors, said first terminal contact being connected to another of said signal conductors.

15. The switch device as claimed in claim 14 wherein the guard sleeve has a terminal wall at the axial end opposite to said one common axial terminal end, such wall having a plug-in opening receiving the second terminal contact in the form of a plug-in contact.

16. The switch device as claimed in claim 14, wherein said portion of said guard sleeve formed of material with electrically conducting properties is formed of brass.

17. The switch device as claimed in claim 14, wherein said guard sleeve is made of nonmagnetic material.

18. The switch device as claimed in claim 14, wherein said guard sleeve is cylindrical and surrounds the switch coaxially.

19. The switch device as claimed in claim 14, further comprising a circuit board arranged at said one axial terminal end of the guard sleeve as an axial extension thereof in the current path between the signal conductors and the terminal contacts.

20. The switch device as claimed in claim 19, wherein the circuit board is pluggingly connected with the terminal contact of the switch arranged on the terminal end of the switch.

21. The switch device as claimed in claim 14, wherein the switch is a reed contact switch.

22. The switch device as claimed in claim 14, wherein the guard sleeve is provided with an insulating housing composed of a material with electrically nonconducting properties.

23. The switch device as claimed in claim 14, wherein the insulating housing is in the form of a tubular casing shut off at one end and has the guard sleeve plugged into it.

24. The switch device as claimed in claim 14, comprising a clamp attaching the guard sleeve of the device to a cylinder of a piston cylinder arrangement.

* * * * *